US007623819B2

(12) United States Patent
Tress

(10) Patent No.: US 7,623,819 B2
(45) Date of Patent: Nov. 24, 2009

(54) HEATER CONTROLLER SYSTEM FOR A FUSING APPARATUS OF A XEROGRAPHIC PRINTING SYSTEM

(75) Inventor: Tab Alan Tress, Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 514 days.

(21) Appl. No.: 11/542,534

(22) Filed: Oct. 3, 2006

(65) Prior Publication Data

US 2008/0080886 A1 Apr. 3, 2008

(51) Int. Cl.
*G03G 15/20* (2006.01)

(52) U.S. Cl. ..... 399/334

(58) Field of Classification Search ..... 399/45, 399/69, 330, 334; 219/216, 469, 470
See application file for complete search history.

(56) References Cited

U.S. PATENT DOCUMENTS

| | | | | |
|---|---|---|---|---|
| 3,609,402 | A | 9/1971 | Ferro et al. | |
| 4,434,353 | A * | 2/1984 | Marsh et al. | 219/216 |
| 5,029,311 | A | 7/1991 | Brandkamp et al. | |
| 5,481,089 | A | 1/1996 | Furuta | |
| 5,512,993 | A * | 4/1996 | Endo et al. | 399/335 |
| 5,640,231 | A | 6/1997 | Mitsui et al. | |
| 5,966,562 | A | 10/1999 | Maehara | |
| 6,091,059 | A * | 7/2000 | Sato et al. | 219/469 |
| 6,301,454 | B1 * | 10/2001 | Nishida et al. | 399/69 |
| 6,353,718 | B1 | 3/2002 | Roxon et al. | |
| 6,359,266 | B2 | 3/2002 | Little et al. | |
| 6,568,792 | B2 | 5/2003 | Andrews et al. | |
| 6,777,653 | B2 | 8/2004 | Burkhart | |
| 6,901,226 | B2 | 5/2005 | Claassen | |
| 6,931,222 | B2 * | 8/2005 | Okada | 399/88 |
| 7,049,750 | B1 | 5/2006 | Weyhrauch et al. | |
| 7,199,335 | B2 * | 4/2007 | Takami et al. | 219/497 |
| 7,203,438 | B2 * | 4/2007 | Omata et al. | 399/69 |
| 7,269,368 | B2 * | 9/2007 | Sato et al. | 399/69 |
| 7,283,145 | B2 * | 10/2007 | Kato et al. | 347/156 |
| 7,333,743 | B2 * | 2/2008 | Kishi et al. | 399/69 |
| 2003/0230563 | A1 | 12/2003 | Miura | |
| 2006/0045591 | A1 | 3/2006 | Chae et al. | |

FOREIGN PATENT DOCUMENTS

| | | | |
|---|---|---|---|
| JP | 10143003 | A * | 5/1998 |
| JP | 2000235325 | A * | 8/2000 |
| JP | 2005284093 | A * | 10/2005 |
| KR | 2006018305 | A * | 3/2006 |

OTHER PUBLICATIONS

European Search Report for EP 07117882.6-2209 dated Feb. 28, 2008.

* cited by examiner

*Primary Examiner*—Robert Beatty
(74) *Attorney, Agent, or Firm*—Carter, DeLuca, Farrell & Schmidt, LLP

(57) ABSTRACT

A heater controller system for a fusing apparatus configured for fusing marking material to a substrate in a printing system includes a power source for supplying power to a heating element having at least two sections. The controller system further includes at least one switch configured to selectively control at least two bidirectional switches for selectively providing current supplied by the power source to at least one of the at least two sections during operation of said heater controller system in one of at least two modes of operation, each of the at least two modes of operation corresponds to a particular size of said substrate.

18 Claims, 3 Drawing Sheets

HEATER CONTROLLER SYSTEM FOR A FUSING APPARATUS OF A XEROGRAPHIC PRINTING SYSTEM

BACKGROUND

The present disclosure relates to xerographic printing systems, and, in particular, to a heater controller system for a fusing apparatus of a electrostatographic or xerographic printing system.

In electrostatographic printing, commonly known as xerographic or printing or copying, an important process step is known as "fusing." In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable, non-smudging images are rendered on the substrate.

Currently, the most common design of a fusing apparatus as used in commercial xerographic printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image.

In more sophisticated designs of a fusing apparatus, provisions are taken into account for the fact that sheets of different sizes may be passed through the fusing apparatus, ranging from postcard-sized sheets to sheets that extend the full length of the rolls. These designs provide for controlling the heating element or elements inside the fuser roll to take into account the fact that a sheet of a particular size of paper is fed through the nip. When a relatively large sheet of paper is passed through the nip, the heat is evenly distributed along the length of the fuser roll, while when a smaller sheet is passed through the nip, the heat is radiated only along the portion of the fuser roll corresponding to the sheet size, thereby aiding in the prevention of the fusing apparatus and the xerographic system as a whole from overheating.

However, such fusing apparatus designs for controlling heat radiation along the length of the fuser roll require increasing the mass of the fuser roll, which impacts warm-up response time, and individual controllers for each heating element, which impacts external subsystem electrical hardware costs. Moreover, these prior art fusing apparatus designs do not provide for heating portions or sections of the fusing apparatus in accordance with the dimensions of specific substrate sizes, such as 11" long edge feed and A4 long edge feed performance, being fed through the fusing apparatus.

Accordingly, there exists a need for a heater controller system for a fusing apparatus which overcomes disadvantages in prior art fusing apparatus designs and includes for heating sections in accordance with the dimensions of specific substrate sizes being fed through the fusing apparatus.

SUMMARY

The present disclosure provides a heater controller system for a fusing apparatus configured for fusing marking material to a substrate in a printing system The heater controller system includes a heating element having at least two sections; a power source for supplying power to the heating element; and at least one switch configured to selectively control at least two bidirectional switches for selectively providing current supplied by the power source to at least one of the at least two sections during operation of the heater controller system in one of at least two modes of operation. Each of the at least two modes of operation corresponds to a particular size of the substrate. The printing system is a xerographic printing system.

The present disclosure further provides a heater controller system for a fusing apparatus configured for fusing marking material to a substrate in a printing system. The heater controller system includes a first heating element having at least two sections; a second heating element having at least two sections; a power source for supplying power to the first and second heating elements; and at least two switches configured to selectively control at least two bidirectional switches for selectively providing current supplied by the power source to at least one section of the at least two sections of at least one of the first and second heating elements during operation of the heater controller system in one of at least two modes of operation. Each of the at least two modes of operation corresponds to a particular size of the substrate. The printing system is a xerographic printing system.

BRIEF DESCRIPTION OF THE DRAWINGS

Various embodiments of the present disclosure will be described herein below with reference to the figures wherein.

DETAILED DESCRIPTION

Figure 1:
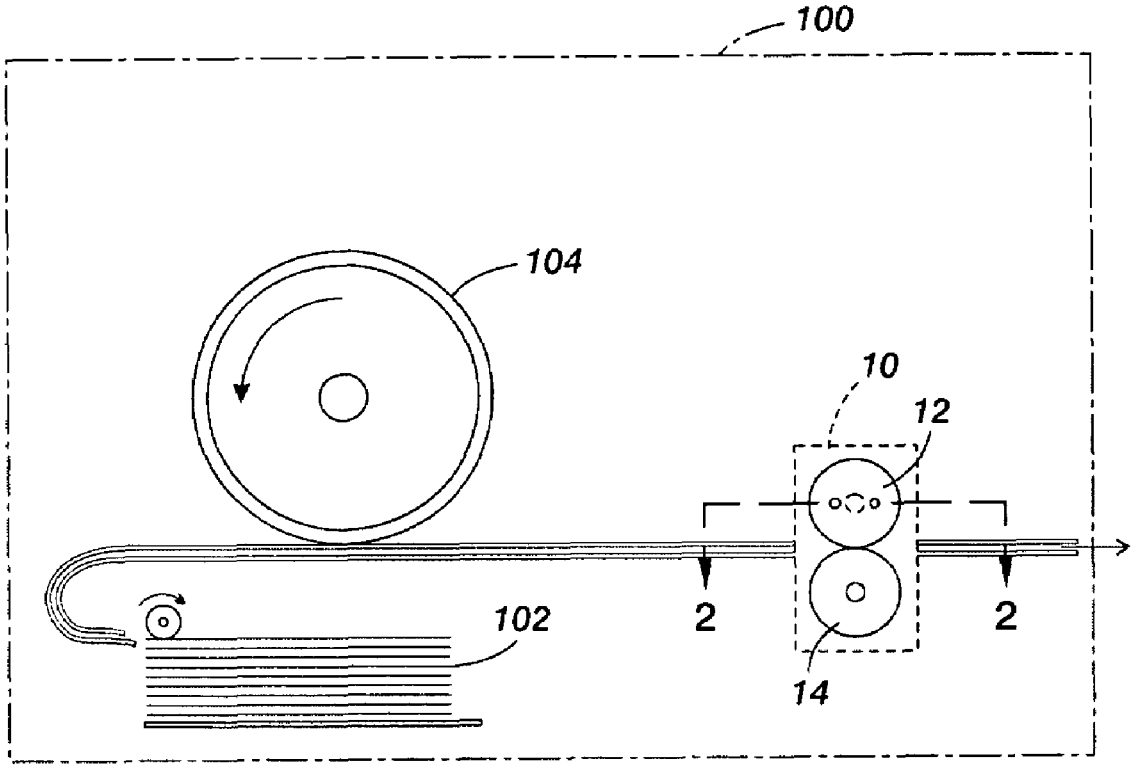
FIG. 1 PRIOR ART
FIG. 1 is a simplified elevational view showing the essential portions of a prior art electrostatographic printer, such as a xerographic printer or copier, relevant to the present disclosure.

For a general understanding of the features of the present disclosure, reference is made to the drawings. In the drawings, like reference numerals have been used throughout to identify identical elements. FIG. 1 is a simplified elevational view showing the essential portions of a prior art electrostatographic printer, such as a xerographic printer or copier, relevant to the present disclosure. A printing apparatus 100, which can be in the form of a digital or analog copier, "laser printer", ionographic printer, or other device, includes mechanisms which draw substrates, such as sheets of paper, from a stack 102 and cause each sheet to obtain a toner image from the surface of a charge receptor 104, on which electrostatic latent images are created and developed through well known processes.

Once a particular sheet obtains marking material from charge receptor 104, the sheet (now a print sheet) is caused to pass through a fusing apparatus such as generally indicated as 10. A typical design of a fusing apparatus 10 includes a fuser roll 12 and a pressure roll 14. Fuser roll 12 and pressure roll 14 cooperate to exert pressure against each other across a nip formed therebetween. When a sheet of paper passes through the nip, the pressure of the fuser roll against the pressure roll contributes to the fusing of the image on a sheet. Fuser roll 12 further includes means for heating the surface of the roll, so that the heat can be supplied to the sheet in addition to the pressure, further enhancing the fusing process. Typically, the fuser roll 12, having the heating means associated therewith, contacts the side of the sheet having the image desired to be fused.

Generally, the most common means for generating the desired heat within the fuser roll 12 is one or more heating elements within the interior of fuser roll 12, so that heat generated by the heating elements will cause the outer surface of fuser roll 12 to reach a desired temperature. Various configurations for heating elements have been discussed above with regard to the prior art. Basically, the heating elements can comprise any material which outputs a certain amount of heat in response to the application of electrical power thereto; such heat-generating materials are well known in the art.

Figure 2:
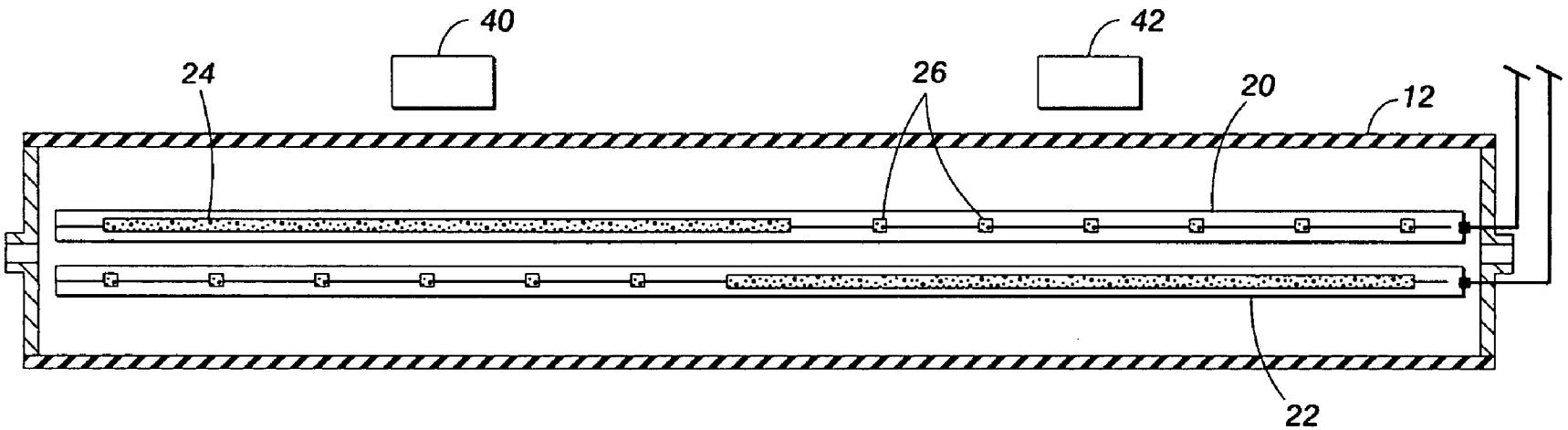
FIG. 2 PRIOR ART
FIG. 2 is a plan sectional view of the fuser roll as viewed through the line marked 2-2 in FIG. 1.

FIG. 2 is a sectional view of the fuser roll 12 as viewed through the line marked 2-2 in FIG. 1. FIG. 2 shows the configuration of heating elements in a fuser roll 12 according to a typical embodiment of a printing apparatus. As can be seen in the Figure, there is disposed within the interior of fuser roll 12 two "lamps," that is, two structures which include heating elements, indicated as 20 and 22. The lamps 20 and 22 are each disposed along the axial length of the fuser roll 12, and as such are disposed to be largely perpendicular to a direction of passage of the sheets passing through the nip of the fusing apparatus 10.

As can be seen in FIG. 2, each lamp, such as 20, includes a specific configuration of heat-producing material. In this particular case, a relatively long major portion of heat-producing material 24, along with a number of smaller portions of heat-producing material, indicated as 26, all of which are connected in series. Within each lamp such as 20 or 22, major portion 24 is disposed toward one particular end of the fuser roll 12, while the relatively smaller portions 26 are disposed toward the opposite end of the fuser roll 12. In one embodiment, the heat-producing material substantially comprises tungsten, while the overall structure of the lamp is borosilicate glass; these materials are fairly common in the fuser-lamp context.

Typically, a control system for regulating the temperature of the fuser roll 12 includes temperature sensors, or thermistors, such as indicated at 40 and 42, each of which monitors the local temperature of the surface of the fuser roll 12. Preferably, thermistors such as 40 and 42 are mounted relative to fuser roll 12 symmetrically relative to a midpoint of fuser roll 12. In this way, each thermistor 40, 42 is directly adjacent equivalent locations along two lamps. This configuration of the thermistors improves the operation of a larger control system.

Figure 3:
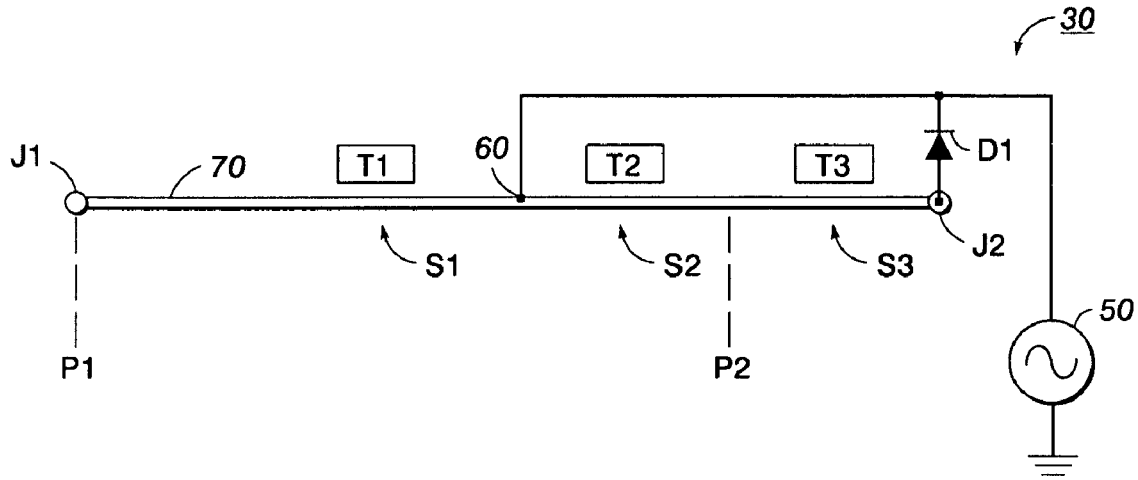
FIG. 3 illustrates a schematic diagram of a heater controller system in accordance with one embodiment of the present disclosure.

To illustrate a particular embodiment of the present disclosure, FIG. 3 shows a heater controller system 30 for controlling segmented heaters interfaced with a heating element 70. Heating element 70 is defined by three sections S1, S2, and S3. Each of sections S1, S2, and S3 is configured to be heated by an applied AC voltage supplied from an AC power source 50. Each section S1, S2, and S3 is heated individually or in combination with another, depending on the sign of the applied voltage. For example, certain sections or combinations of sections of heating element 70 are configured to heat during the negative half-cycle of the AC waveform, or alternatively, during the positive half cycle of the AC waveform. In this manner, AC phase control is used to control the individual sections S1, S2, and S3 of heating element 70 to heat specific portions of the outer surface of fuser roll 12 depending on the size of substrate fed into fusing apparatus 10. In discussing the feeding of substrates into fusing apparatus 10, it is convenient to use the terms long edge feed (LEF) and short edge feed (SEF). Heating element 70 is configured to support three different substrate sizes (e.g., paper sizes), namely, A5 SEF, 11" SEF, and 11" LEF. Typically, the SEF of A5 sheets are about 148 mm, the SEF of 11" sheets are about 215.9 mm, the LEF of 11" sheets are about 279.4 mm. Thus, A5 SEF sheets are supported by the heating of section S1, 11" SEF sheets are supported by the heating of sections S1 and S2 in combination, and 11" LEF sheets are supported by the heating of sections S1, S2, and S3 in combination.

With reference to FIG. 3, controller system 30 includes a CPU (not shown) for executing calculations and control, first and second bidirectional switches or triacs P1 and P2, respectively, an AC power source 50, thermistors T1, T2, and T3, and a unidirectional switch or diode D1. Triacs P1 and P2 and thermistors T1, T2, and T3 are interfaced with the CPU, e.g., via connection through a bus (not shown). It should be understood that thermistors T1, T2, and T3 are held in light contact with the outer surface of fuser roll 12 and are included in FIG. 3 for illustrative purposes only. The end terminal of section S1 defines a junction 11 and the end terminal of section S3 defines a junction 12. Sections 51 and S2 are separated by a centertap 60. Centertap 60 is serially connected with the cathode of diode D1. The anode of diode D1 is connected to the end terminal of section S3 at junction 12. Triac P1 and heating element 70 are serially connected at junction 11, triac P2 and heating element 70 are serially connected between sections S2 and S3, and these serial circuits are connected in parallel with power source 50. Triacs P1 and P2 arc turned ON and OFF by high/low levels of a signal received from the CPU. It should be understood that electrons move towards power source 50 during the positive half-cycle conduction phase and away from power source 50 during the negative half-cycle conduction phase.

Heater controller system 30 further includes temperature sensors, or thermistors, such as indicated at T1, T2 and T3, each of which is held in light contact with the surface of the fuser roll 12, so that thermistors T1, T2, and T3 monitor the local temperature of a section of the surface of fuser roll 12 corresponding to sections S1, S2, and S3 of heating element 70, respectively. In operation, sections S1, S2, and S3 heat the surface of fuser roll 12 to a predetermined temperature F1 optimized for fusing performance, as monitored by thermistors T1, T2, and T3, respectively. The results of detection by thermistors T1, T2, and T3 are supplied into the CPU.

The sensing of substrate size and orientation is well known in the art. For example, this can be by any suitable automatic measuring and sensing technique or by manually entering size and orientation information into the CPU via user interface of fusing apparatus 10. In a first mode of operation optimized for A5 SEF sheet performance, A5 SEF sheet size information either is automatically sensed by fusing apparatus 10 or is manually entered by a user. Upon receipt of the sheet size information or temperature detected by thermistor T1 to be below temperature F1, triac P1 is triggered by the CPU to conduct during both the positive and negative half cycles of the AC waveform supplied from power source 50, thereby permitting current to flow from power source 50 through centertap 60 via a shorting connection. Both positive and negative half cycles of the AC waveform are sunk by junction J1. In this manner, section S1 heats the outer surface of fuser roll 12 to temperature F1. The outer surface temperature is monitored by thermistor T1. If the outer surface temperature exceeds temperature F1, power to section S1 of heating element 70 is lowered. During the first mode of operation, triac P2 is not triggered to conduct either half-cycle of the AC waveform from power source 50.

In a second mode of operation optimized for 11"SEF sheet performance, 11"SEF sheet size information either is sensed by fusing apparatus 10 or is manually entered by a user. Upon receipt of the sheet size information or temperature detected by thermistor T1 to be below temperature F1, triac P1 is triggered by the CPU to conduct during the negative half-cycle of the AC waveform supplied from power source 50 and triac P2 is triggered by the CPU to conduct during the positive half-cycle of the AC waveform from power source 50. Thus, current is permitted to flow from power source 50 through center tap 60 via a shorting connection. The negative half-cycle of the AC waveform is sunk by junction J1 and the positive half-cycle of the AC waveform is sunk by junction J2. During the positive half-cycle of the applied AC, the voltage across diode D1 is the full-applied AC voltage, thus, current does not flow through diode D1 during the second mode of operation. In this manner, sections S1 and S2 of heating element 70 heat the outer surface of fuser roll 12 to temperature F1. The outer surface temperature is monitored by thermistors T1 and T2. If the outer surface temperature detected exceeds temperature F1, power to sections S1 and/or S2 of heating element 70 is lowered.

In a third mode of operation optimized for 11" LEF sheet performance, 11"LEF sheet size information either is sensed by fusing apparatus 10 or manually entered by a user. Upon receipt of the sheet size information or temperature detected by thermistor T1 to be below temperature F1, triac P1 is triggered by the CPU to conduct during the positive half-cycle of the AC waveform supplied from power source 50 and triac P2 is triggered by the CPU to conduct during the negative half-cycle of the AC waveform supplied from power source 50. Thus, current is permitted to flow from power source 50 through center tap 60 via a shorting connection. The positive half-cycle conduction of triac P1 is sunk by junction J1 and the negative half-cycle conduction of triac P2 is sunk by junction J2. During the negative half-cycle of the applied AC, diode D1 is in the conductive state and, thus, current is permitted to flow through diode D1. In this manner, sections S2 and S3 are both heated for 11"LEF performance by the negative half-cycle of the AC waveform and section S1 is heated for 11"LEF performance by the positive half-cycle of the AC waveform. Specifically, sections S1, S2, and S3 of heating element 70 heat the outer surface of fuser roll 12 to temperature F1. The outer surface temperature is monitored by thermistors T1, T2, and T3. If the outer surface temperature detected exceeds temperature F1, power to sections S1, S2 and/or S3 of heating element 70 is lowered.

Figure 4:
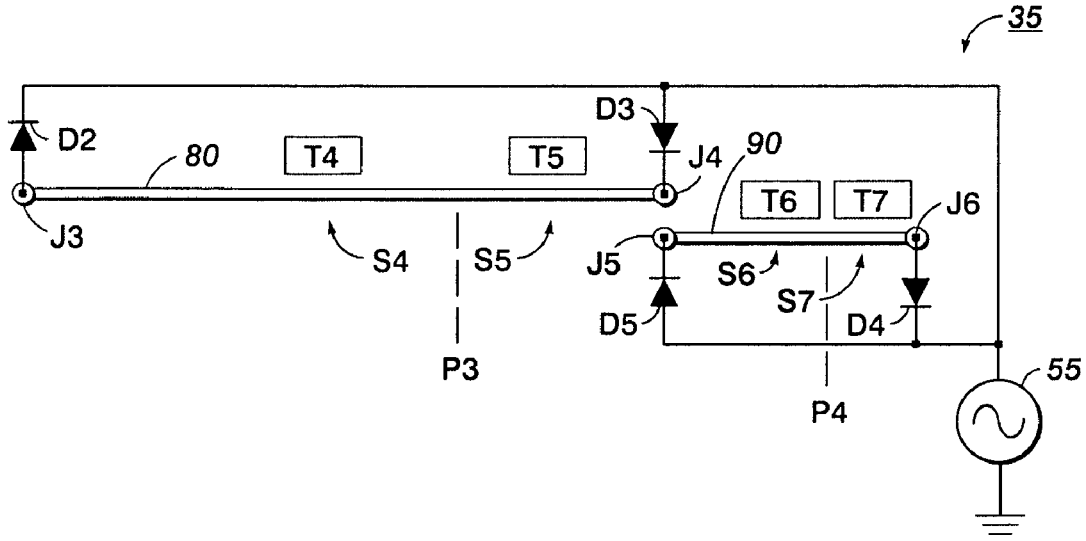
FIG. 4 illustrates a schematic diagram of a heater controller system in accordance with another embodiment of the present disclosure.

With reference to FIG. 4, a heater controller system 35 according to another embodiment of the present disclosure will now be described. Controller system 35 is interfaced with heating elements 80 and 90. Heating element 80 is defined by two sections S4 and S5. Each of sections S4 and S5 is configured to be heated by an applied AC voltage supplied from power source 50. Heating element 80 is configured to support two different substrates sizes, namely A5 SEF and 11" LEF. Heating element 90 in combination with heating element 80 is configured to support two additional substrate sizes, namely 11" LEF and A4 LEF.

Controller system 35 includes a CPU (not shown) for executing calculations and control, first and second bidirectional switches or triacs P3 and P4, respectively, an AC power source 55, thermistors T4, T5, T6, and T7, and switches or diodes D2, D3, D4, and D5. It should be understood that thermistors T4, T5, T6, and T7 are held in light contact with the outer surface of fuser roll 12 and are included in FIG. 4 for illustrative purposes only. Triacs P3 and P4 and thermistors T4, T5, T6, and T7 are interfaced with the CPU, e.g., via connection through a bus (not shown). Diodes D2 and D4 are configured to conduct only during the negative half-cycle of the applied AC voltage. Diodes D3 and D5 are configured to conduct only during the positive half-cycle of the applied AC voltage.

With reference to heating element 80 in FIG. 4, the end terminal of section S4 defines a junction J3 and the end terminal of section S5 defines a junction J4. The anode of diode D3 is serially connected to power source 55 and the cathode of diode D3 is serially connected to the terminal end of section S5 at junction J4. The anode of diode D2 is serially connected to the terminal end of section S4 at junction S3 and the cathode of diode D2 is serially connected to the anode of diode D3. With reference to element 90 in FIG. 4, the end terminal of section S6 defines a junction J5 and the end terminal of section S7 defines a junction J6. The cathode of diode D5 is serially connected to the end terminal of section S6 at junction at junction J5 and the anode of diode D5 is serially connected to the cathode of diode D4. The anode of diode D4 is serially connected to the end terminal of section S7 at junction J6.

Triac P3 and heating element 80 are serially connected between sections S4 and S5, triac P4 and heating element 90 are serially connected between sections S6 and S7, and these serial circuits are connected in parallel with power source 55. Triacs P3 and P4 are turned ON and OFF by high/low levels of a signal received from the CPU.

Heater controller system 35 further includes temperature sensors, or thermistors, such as indicated at T4, T5 T6, and T7, each of which is held in light contact with the surface of the fuser roll 12, so that thermistors T4, T5 T6, and T7 monitor the local temperature of a section of the surface of fuser roll 12 corresponding to sections S4, S5, S6, and S7 of heating elements 80 and 90. In operation, sections S4, S5, S6, and S7 heat the surface of fuser roll 12 to a predetermined temperature F2 optimized for fusing performance, as monitored by thermistors T4, T5 T6, and T7, respectively. The results of detection by thermistors T4, T5 T6, and T7 are supplied into the CPU.

In a first mode of operation optimized for A5 SEF sheet performance, A5SEF sheet size information either is sensed by fusing apparatus 10 or manually entered by a user. Upon receipt of the sheet size information or temperature detected by thermistor T4 to be below temperature F2, triac P3 is triggered by the CPU to conduct during the negative half cycle of the AC waveform supplied from power source 55. The negative half-cycle conduction of triac P3 is sunk by J3 with current being permitted to flow through diode D2. In this manner, section S4 of heating element 80 heats the outer surface of fuser roll 12 to temperature F2. The outer surface temperature is monitored by thermistor T4. If the outer surface temperature exceeds temperature F2, power to section S4 is lowered. During the first mode of operation, triac P4 is not triggered to conduct either half-cycle of the AC waveform supplied from power source 55.

In a second mode of operation optimized for 11"SEF sheet size performance, 11"SEF sheet size information either is sensed by fusing apparatus 10 or manually entered by a user. Upon receipt of the sheet size information or temperature detected by thermistor T5 to be below temperature F2, triac P3 is triggered by the CPU to conduct during both the positive and negative half-cycles of the AC waveform supplied from power source 55. The negative half-cycle conduction of triac P3 is sunk by junction J3 with current being permitted to flow through diode D2 and the positive half-cycle conduction of triac P3 is sunk by junction J4 with current being permitted to flow through diode D3. In this manner, sections S4 and S5 of heating element 80 heat the outer surface of fuser roll 12 to temperature F2. The outer surface temperature is monitored by thermistors T4 and T5. If the outer surface temperature exceeds temperature F2, power to sections S4 and/or S5 is lowered. During the second mode of operation, triac P2 is not triggered to conduct either half-cycle of the AC waveform from power source 55.

In a third mode of operation optimized for 11" LEF sheet size performance, 11" LEF sheet size either is sensed by fusing apparatus 10 or manually entered by a user. Upon receipt of the sheet size information or temperature detected by thermistor T6 to be below temperature F2, triac P3 is triggered by the CPU to conduct during both the positive and negative half-cycles of the AC waveform supplied from power source 55 and triac P4 is triggered by the CPU to conduct during the positive half-cycle of the AC waveform supplied from power source 55. The positive half-cycle conducted by triac P4 is sunk by junction J5 with current being permitted to flow through diode D5. In this manner, sections S4 and S5 of heating element 80 heat the outer surface of fuser roll 12 to temperature F2 in accordance with the second mode of operation discussed above and section S6 of element 90 heats the outer surface of fuser roll 12 to temperature F2. The outer surface temperature is monitored by thermistors T4, T5, and T6. If the outer surface temperature exceeds temperature F2, power to sections S4, S5, and/or S6 is lowered.

In a fourth mode of operation optimized for A4 LEF sheet size performance, A4 LEF sheet size information either is sensed by fusing apparatus 10 or manually entered by a user. Upon receipt of the sheet size information or temperature detected by thermistor T7 to be below temperature F2, triac P3 is triggered by the CPU to conduct during both the positive and negative half-cycles of the AC waveform supplied from power source 55 and triac P4 is triggered by the CPU to conduct during both the positive and negative half-cycles of the AC waveform supplied from power source 55. The positive half-cycle conducted by triac P4 is sunk by junction J5 with current being permitted to flow through diode D5 and the negative half-cycle conducted by triac P4 is sunk by junction J6 with current being permitted to flow through diode D4. In this manner, sections S4 and S5 of heating element 80 heat the outer surface of fuser roll 12 to temperature F2 in accordance with the second mode of operation discussed above and sections S6 and S7 of element 90 heat the outer surface of fuser roll 12 to temperature F2. The outer surface temperature is monitored by thermistors T4, T5, T6, and T7. If the outer surface temperature exceeds temperature F2, power to sections S4, S5, S6, and/or S7 is lowered.

As to be appreciated, heater controller system 35 may be simplified such that each of heating elements 80 and 90 may be powered by receiving power only to one section of each element. Specifically, when one section of each heating element is powered, the AC waveform may be mirrored to complete the AC sine wave. Thus, power is provided to the unpowered section. For example, section S5 of heating element is powered by the positive half-cycle of the AC waveform supplied from power source 55. By mirroring the AC waveform, the negative half-cycle of the AC waveform powers section S4. In this configuration, thermistor T4 monitors the surface temperature of fuser roll 12 which corresponds to heating element 80 in its entirety. Likewise, thermistor T6 monitors the surface temperature of fuser roll 12 which corresponds to heating element 90 in its entirety. Thermistors T5 and T7 are configured to control heating elements 80 and 90, respectively, by monitoring temperature and requesting power as is needed for printing performance.

It will be appreciated that variations of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

The invention claimed is:

1. A heater controller system for a fusing apparatus configured for fusing marking material to a substrate in a printing system, said heater controller system comprising:

a heating element having at least two sections;

a power source for supplying power to said heating element wherein the power source provides an AC waveform; and at least one unidirectional switch configured to selectively control at least two bidirectional switches for selectively providing current supplied by the power source to at least one of the at least two sections during operation of said heater controller system in one of at least two modes of operation, each of the at least two modes of operation corresponds to a particular size of said substrate, wherein the heater control system is configured such that when power is provided to at least one of the at least two sections of the heating clement via a first half of the AC waveform, power is provided to at least another of the at least two sections of the heating element via a second half of the AC waveform.

2. A heater controller system according to claim 1, wherein the at least one unidirectional switch is at least one diode and the at least two bidirectional switches are at least two triacs.

3. A heater controller system according to claim 1, wherein the size of the substrate is selected from the group consisting of A5 short edge feed, 11" short edge feed, and 11" long edge feed.

4. A heater controller system according to claim 3, wherein in a first mode of operation of the at least two modes of operation the size of the substrate is A5 short edge feed, in a second mode of operation of the at least two modes of operation the size of the substrate is 11" short edge feed, and in a third mode of operation of the at least two modes of operation the size of the substrate is 11" long edge feed.

5. A heater controller system according to claim 1, wherein the printing system is a xerographic printing system.

6. A heater controller system for a fusing apparatus configured for fusing marking material to a substrate in a printing system, said heater controller system comprising:

a first heating element having at least two sections;

a second heating element having at least two sections;

a power source for supplying power to the first and second heating elements wherein the power source provides an AC waveform; and at least two unidirectional switches configured to selectively control at least two bidirectional switches for selectively providing current supplied by the power source to at least one section of the at least two sections of at least one of the first and second heating elements during operation of said heater controller system in one of at least two modes of operation, each of the at least two modes of operation corresponds to a particular size of said substrate, wherein the heater control system is configured such that when power is provided via a first half of the AC waveform to at least one of the at least two sections of one of the first heating element and the second heating element, power is provided via a second half of the AC waveform to at least another of the at least two sections of one of the first heating element and the second heating element, respectively.

7. A heater controller system according to claim 6, wherein the at least two unidirectional switches are at least two diodes and the at least two bidirectional switches are at least two triacs.

8. A heater controller system according to claim 6, wherein the size of the substrate is selected from the group consisting of A5 short edge feed, A5 long edge feed, 11" short edge feed, and 11" long edge feed.

9. A heater controller system according to claim 8, wherein in a first mode of operation of the at least two modes of operation the size of the substrate is A5 short edge feed, in a second mode of operation of the at least two modes of operation the size of the substrate is 11" short edge feed, in a third mode of operation of the at least two modes of operation the size of the substrate is 11" long edge feed, and in a fourth mode of operation of the at least two modes of operation the size of the substrate is A4 long edge feed.

10. A heater controller system according to claim 6, wherein the printing system is a xerographic printing system.

11. A xerographic printing system comprising:

a fusing apparatus configured for fusing marking material to a substrate; and a heater controller system comprising:

a heating element having at least two sections;

a power source for supplying power to said heating element wherein the power source provides an AC waveform; and at least one unidirectional switch configured to selectively control at least two bidirectional switches for selectively providing current supplied by the power source to at least one of the at least two sections during operation of said heater controller system in one of at least two modes of operation, each of the at least two modes of operation corresponds to a particular size of said substrate provided to said fusing apparatus, wherein the heater control system is configured such that when power is provided via a first half of the AC waveform to at least one of the at least two sections of the heating element, power is provided via a second half of the AC waveform to at least another of the at least two sections of the heating element, respectively.

12. A xerographic printing system according to claim 11, wherein the at least one unidirectional switch is at least one diode and the at least two bidirectional switches are at least two triacs.

13. A xerographic printing system according to claim 11, wherein the size of the substrate is selected from the group consisting of A5 short edge feed, 11" short edge feed, and 11" long edge feed.

14. A xerographic printing system according to claim 13, wherein in a first mode of operation of the at least two modes of operation the size of the substrate is A5 short edge feed, in a second mode of operation of the at least two modes of operation the size of the substrate is 11" short edge feed, and in a third mode of operation of the at least two modes of operation the size of the substrate is 11" long edge feed.

15. A xerographic printing system comprising:

a fusing apparatus configured for fusing marking material to a substrate; and a heater controller system comprising:

a first heating element having at least two sections;

a second heating element having at least two sections;

a power source for supplying power to the first and second heating elements wherein the power source provides an AC waveform; and at least two unidirectional switches configured to selectively control at least two bidirectional switches for selectively providing current supplied by the power source to at least one section of the at least two sections of at least one of the first and second heating elements during operation of said heater controller system in one of at least two modes of operation, each of the at least two modes of operation corresponds to a particular size of said substrate provided to said fusing apparatus, wherein the heater control system is configured such that when power is provided via a first half of the AC waveform to at least one of the at least two sections of one of the first heating element and the second heating element, power is provided via a second half of the AC waveform to at least another of the at least two sections of one of the first heating element and the second heating element, respectively.

16. A xerographic printing system according to claim 15, wherein the at least two unidirectional switches are at least two diodes and the at least two bidirectional switches are at least two triacs.

17. A xerographic printing system according to claim 15, wherein the size of the substrate is selected from the group consisting of A5 short edge feed, A5 long edge feed, 11" short edge feed, and 11" long edge feed.

18. A xerographic printing system according to claim 17, wherein in a first mode of operation of the at least two modes of operation the size of the substrate is A5 short edge feed, in a second mode of operation of the at least two modes of operation the size of the substrate is 11" short edge feed, in a third mode of operation of the at least two modes of operation the size of the substrate is 11" long edge feed, and in a fourth mode of operation of the at least two modes of operation the size of the substrate is A4 long edge feed.

* * * * *